US009109366B2

(12) United States Patent
Schulte

(10) Patent No.: US 9,109,366 B2
(45) Date of Patent: Aug. 18, 2015

(54) COVERING MADE FROM MECHANICALLY INTERCONNECTABLE PANELS

(76) Inventor: Guido Schulte, Rüthen-Meiste (DE)

( * ) Notice: Subject to any disclaimer, the term of this patent is extended or adjusted under 35 U.S.C. 154(b) by 11 days.

(21) Appl. No.: 13/387,579

(22) PCT Filed: Jul. 13, 2010

(86) PCT No.: PCT/DE2010/000807

§ 371 (c)(1),
(2), (4) Date: Mar. 30, 2012

(87) PCT Pub. No.: WO2011/012105

PCT Pub. Date: Feb. 3, 2011

(65) Prior Publication Data

US 2012/0174519 A1 Jul. 12, 2012

(30) Foreign Application Priority Data

Jul. 27, 2009 (DE) ..... 10 2009 034 903

(51) Int. Cl.

| | |
|---|---|
| ***E04C 2/38*** | (2006.01) |
| ***B23P 17/04*** | (2006.01) |
| ***E04F 13/08*** | (2006.01) |
| ***E04F 15/02*** | (2006.01) |

(52) U.S. Cl.

CPC ..... *E04F 13/08* (2013.01); *E04F 15/02* (2013.01); *E04F 2201/0115* (2013.01); *E04F 2201/0138* (2013.01); *E04F 2201/0153* (2013.01); *E04F 2201/0523* (2013.01); *E04F 2201/0541* (2013.01); *Y10T 29/49815* (2015.01); *Y10T 29/49826* (2015.01)

(58) Field of Classification Search

CPC ..... E04F 15/02005; E04F 15/02038; E04F 15/04

USPC ..... 52/588.1, 582.1, 586.1, 589.1, 592.1, 52/592.4

See application file for complete search history.

(56) References Cited

U.S. PATENT DOCUMENTS

| | | | | |
|---|---|---|---|---|
| 6,216,409 | B1 * | 4/2001 | Roy et al. | 52/589.1 |
| 7,721,503 | B2 * | 5/2010 | Pervan et al. | 52/586.1 |
| 8,302,367 | B2 * | 11/2012 | Schulte | 52/747.11 |

(Continued)

FOREIGN PATENT DOCUMENTS

| | | | |
|---|---|---|---|
| DE | 102007020271 | A1 * | 8/2008 |
| DE | 20 2009 004530 | U1 | 6/2009 |

(Continued)

*Primary Examiner* — Rodney Mintz

(74) *Attorney, Agent, or Firm* — Henry M. Feiereisen LLC

(57) ABSTRACT

The invention relates to a covering comprising mechanically interconnectable panels having the following characteristics: —adjacent first and second panels (1, 2) each have a groove (12, 17) on their mutually complementary sides, —in one of the grooves (12) a tongue (16) is arranged which is displaceable relative to the panel (1) and which is configured to engage in the groove (17) of the adjacent panel (2) when connecting the adjacent panels (1, 2), —the panel (1) which holds the tongue (16) has a lower locking rail (3) which engages the adjacent panel (2) underneath which is configured to secure adjacent panels (1, 2) against tensile loading in the plane of installation, —the panel (2) engaged underneath by the locking rail (3) is supported on the locking rail (3) as well as on the support rail (11) which is arranged at a greater distance to the locking rail (3) than the groove (12), —the support rail (11) engages in the same groove (17) into which the tongue (16) is displaceable.

18 Claims, 4 Drawing Sheets

(56) References Cited

U.S. PATENT DOCUMENTS

| | | | | |
|---|---|---|---|---|
| 8,341,915 | B2 * | 1/2013 | Pervan et al. | 52/586.1 |
| 8,752,352 | B2 * | 6/2014 | Schulte | 52/588.1 |
| 8,806,832 | B2 * | 8/2014 | Kell | 52/588.1 |
| 8,869,485 | B2 * | 10/2014 | Pervan | 52/582.1 |
| 2008/0134613 | A1 * | 6/2008 | Pervan | 52/582.2 |
| 2010/0319291 | A1 * | 12/2010 | Pervan et al. | 52/588.1 |
| 2011/0011026 | A1 * | 1/2011 | Cappelle et al. | 52/588.1 |
| 2011/0094178 | A1 * | 4/2011 | Braun | 52/588.1 |
| 2011/0225921 | A1 * | 9/2011 | Schulte | 52/588.1 |
| 2011/0271632 | A1 * | 11/2011 | Cappelle et al. | 52/582.2 |
| 2012/0192521 | A1 * | 8/2012 | Schulte | 52/588.1 |
| 2014/0033633 | A1 * | 2/2014 | Kell | 52/588.1 |
| 2014/0283466 | A1 * | 9/2014 | Boo | 52/105 |
| 2015/0000221 | A1 * | 1/2015 | Boo | 52/588.1 |

FOREIGN PATENT DOCUMENTS

| | | | |
|---|---|---|---|
| EP | 2 037 128 | A1 | 3/2009 |
| WO | WO 2007/081267 | A1 | 7/2007 |
| WO | WO 2008/017301 | A2 | 2/2008 |

* cited by examiner

COVERING MADE FROM MECHANICALLY INTERCONNECTABLE PANELS

CROSS-REFERENCES TO RELATED APPLICATIONS

This application is the U.S. National Stage of International Application No. PCT/DE2010/000807, filed Jul. 13, 2010, which designated the United States and has been published as International Publication No. WO 2011/012105 A1 and which claims the priority of German Patent Application, Serial No. 10 2009 034 903.0, filed Jul. 27, 2009, pursuant to 35 U.S.C. 119(a)-(d).

BACKGROUND OF THE INVENTION

The invention relates to a covering made from mechanically interconnectable panels as well as an installing and uninstalling method for such a covering.

Wall, ceiling, and floor coverings, such as for example prefabricated parquet, real wood floors or laminate floorings, consist of several rows of predominantly rectangular panels. Conventionally, the panels have continuous grooves on a longitudinal side and a head side, and, on the respective opposing longitudinal side or head side, respectively, continuous tongues which form fittingly match the grooves. The panels are installed by joining the groove and tongue, wherein the panels of two neighboring rows are arranged offset to each other. It is known to provide the grooves and tongues with mechanical locking means which, in neighboring panels in a floor covering, form a latching engagement with one another. This is intended to prevent the formation of gaps in the installed floor through stretching or shrinking processes. The groove and tongue are provided with mutually matching locking elements in the form of indentations, recesses or projections, to retain connected floor panels in the joined position without the use of adhesives. Normally, the panels are turned or clicked into each other along their longitudinal sides and subsequently shifted sideways, such that locking rails on the head sides engage. To facilitate this, slight hammer strikes can be used in connection with a tapping block. This poses the risk of damage to the panels, even when working most carefully.

Solutions also exist, in which the abutting head sides are connected by a tongue which is displaceable in its longitudinal direction. This obviates the manual tapping-in with a hammer. The tongues are pre-assembled, which obviates the subsequent inserting. Such a floor covering is the subject matter of WO 2008/017301. In this case, a projecting end of a tongue is displaced into a head side groove, to partially displace the tongue from one groove to the corresponding groove of the neighboring panel. In this way the panels are interlocked.

WO 2007/081267 A1 discloses a covering from mechanically interconnectable panels, wherein adjacent first and second panels each have a groove on their mutually complementary sides. In one of the grooves a tongue is arranged, which is displaceable relative to the panel and which is configured to engage in the groove of the adjacent panel when joining the adjacent panels. The panel which holds the tongue has a locking rail which engages underneath the adjacent panel. The locking rail is suited to protect adjacent panels against tensile loading in a plane of installation, wherein the panel engaged underneath by the locking rail is supported by the locking rail as well as a support rail. The support rail is arranged at a greater distance to the locking rail than the groove.

To enable the displacement of the tongue, the tongue must be held with a certain play and inserted into the exactly oriented corresponding opposite groove of the complementary panel. This play is preferably as small as possible to prevent a height offset in the region of the gap clearance of two panels. For technical reasons a certain play cannot be avoided, however.

SUMMARY OF THE INVENTION

The invention is based on the object to provide a covering in form of mechanically interconnectable panels in which the height offset in the region of the gap clearance is minimal and which is designed to be particularly easy to install and to be removed again.

According to one aspect of the invention, the object is solved with a covering made from mechanically interconnectable panels wherein adjacent first and second panels each have a groove on their mutually complementary sides, wherein in one of the grooves a tongue is arranged, which is displaceable relative to the panel and which is configured to engage in the groove of the adjacent panel when connecting the adjacent panels, wherein the panel which holds the tongue has a lower locking rail engaging underneath the adjacent panel which is configured to secure adjacent panels against tensile loading in the plane of installation, wherein the panel engaged underneath by the locking rail is supported on the locking rail as well as on a support rail which is arranged at a greater distance to the locking rail than the groove, and wherein the support rail engages in the same groove into which the tongue is displaceable.

The sub claims relate to advantageous refinements of the invention.

The panels according to the invention are intended and configured to be mechanically connected to other similar panels. The connection occurs via connecting elements arranged on the complementary sides of the panels in form of groove and tongue connections. The complementary sides can be head sides and/or longitudinal sides. Within the context of this invention, adjacent first and second panels therefore each have a respective groove on their mutually complementary sides. In one of the grooves a tongue is arranged which is displaceable relative to the panel, and which is configured to engage in a groove of the adjacent panel when connecting the adjacent panels. Preferably, the interlocking or joining, respectively, of the panels only occurs when a further panel with its longitudinal side engages with the longitudinal sides of the preceding row of panels and during this, pushes an end of the tongue which protrudes out of the groove into the groove, such that this shifting causes a head side locking of the mutually complementary head sides of the adjacent panels.

In addition to the tongue, the panel which originally held the tongue, has a locking rail which engages underneath the adjacent panel, which locking rail is suited to protect adjacent panels from tensile loading in a plane of installation. The locking rails therefore serve to couple the panels in the plane of installation while the tongues are intended to prevent that the panels are displaced vertically relative to on another. Because the locking rail, which engages underneath the adjacent panel, is arranged at a relatively great distance to the top side of the panels, it is further provided that the panel engaged underneath by the locking rail is primarily supported by a support rail. This support rail is arranged at a greater distance to the locking rail than the groove, in other words, the groove is located between the support rail and the locking rail. The support rail has the function to reduce the distance between the point of support to the top side of the panel, which is particularly advantageous in the case of thin walled and soft materials. Because of the proximity of the support rail to the top side of the panels, vertical forces which act on the panel, which is engaged underneath, selectively at points close to a gap clearance, are conducted into the adjacent panel which engages underneath via a shorter distance than would be possible via the lower positioned locking rail. Because of the support in direct proximity to the point of the applied force, the height offset between two panels is significantly smaller in the case of force loading.

Because the support rail is preferably arranged directly adjacent to the tongue, the support rail can engage into the similar or same, respectively, groove into which the tongue is also displaceable. The groove is configured correspondingly wider than the tongue that is provided for locking.

The distance of the support rail to the top side of the panel is preferably 10% to 35% of a total thickness of the panel. In an advantageous refinement, the support rail can therefore preferably be arranged at a distance to the top side of the panel of not more than 3 mm to 5 mm. Of course, the concrete distance depends largely on the thickness of the decor layer of the panel. The panel itself can have a relatively small thickness of from 8 mm to 10 mm.

Because in the laminate region very thin thicknesses are desired, the locking rail can be directly adjacent to the groove. In this case, the lower edge of the support rail can even be part of an upper groove flank of the groove. Put another way, the vertical region of the panel, which extends above the support rail until the top side, is slightly offset backwards. By this, the desired support rail is formed as well.

Of course, it is also conceivable, that the support rail protrudes over the groove mouth, with the consequence that a lower groove flank of the groove is shorter than the upper groove flank of the groove. It is also possible that an indentation is arranged bordering the top side of the support rail at a side of the panel. The indentation does not refer to the already protruding support rail but to the vertical region of the panel which adjoins the indentation above and extends to the top side of the panel. Through such an indentation it is easier manufacturing wise to construct the support rail without interfering rounding or chamfer in the corner area, which would decrease the support area. The corner area is quasi displaced deeper into the panel, such that the protruding region of the support rail is available for support in its entirety. This is important because the support rail should not be larger than necessary. In certain circumstances a protrusion of less than 1 mm is sufficient, preferably in the range of 0.5 mm.

For example, the width of the groove into which the tongue is to be displaced, at the narrowest point can be larger than 1.1 times the width of the tongue. in other words the support rail has a thickness which is at least about 10% of the thickness of the tongue.

In the locking position of the tongue, the support rail adjacent to the tongue is supported directly at the top side of the tongue, which in turn rests against the lower groove flank of the respective grooves and by that conducts the applied forces into the lower half of the panel and with that into the ground. This allows using relatively thin support rails without the risk that the support rail brakes off. This also means however, that other constructive possibilities exist with regard to the locking rails, because the vertically acting forces are now conducted into the support rail and only to a lesser degree into the locking rail. To avoid a double fit the panel which is engaged underneath is supported primarily by the support rail, while the locking rail primarily serves to connect the panels to each other in horizontal direction. For this, a beveled surface is provided on the locking rail. A force which applies here can be divided into a horizontal and a vertical force vector. The horizontal force vector determines the force by which the panels are pushed against each other in horizontal direction. Additionally, however a smaller, vertical vector also exists because the panels have to be pivoted downwards with a certain minimal force application. When the folded down panel contacts the beveled surface it slides on the beveled surface into the correct position. The beveled surface is preferably convex. In an embodiment of the convex beveled surface two or more convex sections with different radii merge into each other. In the region of contact, which means in the mounted position, the angle to the horizontal is <90°, preferably <60° in particular <55°. The angle of the beveled surface can facilitate a subsequent loosening which means lifting, of the panel. At angles of >70° a very good locking occurs, however, the destruction free removal of the panel, which means a subsequent lifting, is impeded or even made impossible.

It is useful when the lower groove flank of the panel, which is engaged underneath by the locking rail, widens toward the groove mouth. This widening can be a bevel or a convex rounding, which for example is elliptical. The purpose of such a groove, which widens at the mouth side is that the tongue must be displaced from the lower groove flank in the direction of the upper groove with increasing insertion depth. The displacement is impeded however, by the tongue being urged against the bottom side of the support rail, which at least partially forms the upper groove flank. The bottom side of the tongue in a certain sense runs onto the ramp shaped or wedge shaped beveled surface of the lower groove flank and by that pulls the panel which is engaged underneath downwards against the support rail. By running onto the beveled surface of the lower groove flank, the tongue is twisted in the direction of the upper groove flank, such that it is wedged between the grooves and is thus subjected to a bending tension. Preferably, the tongue is made from a stiff material to absorb the occurring bending tensions. Through the tensioned tongue the second panel is pushed against the support rail with its upper groove flank and against the coupling bulge with its coupling channel. In the joined position the panels are then additionally braced against each other by the tongue. If a force is now applied to the panel having the support rail, the bottom side of the support rail presses against the tongue and with that on the lower groove flank of the corresponding panel, such that the horizontal orientation of both panels remains the same. The height adjustment at the top side of the decor does not change.

This goal is achieved in particular when the tongue runs onto an elliptical curve of the lower groove flank, whereby the shifted tongue is slightly canted. This is possible because the tongue is very rigid and configured narrow and because a corresponding free space exists within the groove to displace the tongue in the direction of the upper groove flank. This is necessary to achieve the desired canting of the tongue. The cross section of the tongue can vary, for example be rectangular, rectangular with rounded edges or elliptical. A tongue which is rod-like in transverse direction to the groove is also conceivable. The design of the tongue has to take into account that the surface of the tongue which faces toward the bottom side of the panel, at least in the joining region of two panels, rests against the lower groove flanks of both grooves and that the surface of the tongue which faces toward the top side of the panels, at least in the joining region of two panels, rests against the upper groove flanks of the opposing grooves.

It is advantageous for the tongue to be pre-tensioned such that in the installed position is urged horizontally into the complementary groove. This causes the panels to be automatically pulled against each other.

The mounting of the panels according to the invention is particularly easy, when a front tip of the lower groove flank can be guided past the front edge of the support rail without jamming. in other words, the lower vertical region of the panel, which in the installation position is located below the groove and above the locking rail, is slightly offset backwards relative to the upper vertical region, which is located above the support rail, wherein the dimensioning of the support rail determines how far the coupling bulge should be offset backwards. Preferably, the tip of the lower groove flank, and with that of the coupling bulge, lies in the same vertical plane as the front edge of the support rail.

With the panel according to the invention it is possible to optimize floor coverings in their joining region with regard to the height match, even when using relatively thin panels, in particular in the laminate region.

The material for the tongue can be a wood material which means it can be wood or a material which contains wood fibers, or a material which is made from wood as base material such as liquid wood. Metal and metal alloys can also be used for the tongue as well as composite material. Use of bimetals or mixed plastics as well as materials based on thermoplastic or thermosetting material is also possible. The tongue can also be made from a fiber-enforced plastic. The inventive concept is applicable to all floor systems, in which a cover layer is arranged on a carrier such as for example real wood coverings, laminate carriers with lacquered surfaces as cover layer, linoleum, cork on carrier plates etc. The cover layer can in particular be made from decorative paper with overlay, which determines the appearance of the element plate. A floor covering can thus be a parquet floor, a preassembled parquet floor, a real wood floor or a laminate floor.

A According to another aspect of the invention, the object is solved by a method for the installation of the previously described covering whereby a plurality of panels installed in an arrangement are coupled to each other via locking rails which are located on the sides (head sides or longitudinal sides) of the panels, such that adjacent panels engage with one another. The sides are interlocked through the tongues inserted into the grooves, wherein the sides are only locked when a further panel engages with a previously installed panel during which the further panel pushes a protruding end of the tongue of the already installed panel into the groove such that this end engages in the groove of the other side and interlocks the panels. The special feature is that the panels are interconnectable through each of the following three relative movements.

The further panel is connected to the installed panel by horizontal insertion in the direction of the plane of installation, wherein the further panel assumes the locking position by sliding over the locking rail; a top side edge of the further panel is set up against a side of an installed panel, wherein the further panel is pivoted about the edge and displaced into the locking position;

The further panel is placed on the locking rail of the installed panel from above, wherein the grooves of the panels during placement are either oriented parallel to each other or, at the beginning of the placement, are arranged at an angle to each other, which angle is decreased during placement, wherein the pivot axis lies in the plane of installation and extends perpendicularly to the groove.

Variant a) relates to an almost exclusive horizontal displacement in the plane of installation, which in a certain sense corresponds to the known horizontal tapping in, but with the difference that no increased force is necessary because the panel which is to be installed simply slides over the locking rail of the previously installed panel.

Variant b) relates to the pivoting about a certain pivot point which is defined by the decor edge, which means by the top side edges of the panel.

Variant c) refers to the jam-free placement or bending for example in the head region of two panels. The locking which means the shifting of the tongue occurs in this case through a third panel which interacts with the tongue.

The installer therefore has the choice between the horizontal insertion, the pivoting, the placement and the bending. All installation methods are possible with the same end side configuration, which significantly simplifies installation not only for the lay person.

According to still another aspect of the invention, a disassembling method for a covering includes the previously described features. It is essential that, when the tongue is extended and extends in both grooves, the panel which is engaged underneath by the locking rail is pivotal about the top side edge, which borders at the panel with the locking rail, and thus a removal is possible even when the tongue is extended. Principally, this removal is the inverse of the procedure in variant b) of the installation method described above.

BRIEF DESCRIPTION OF THE DRAWING

The invention is described in more detail below by way of an exemplary embodiment shown in the schematic drawings. It shows FIGS. 1*a* to 1*c* each a cross section through the joining region of two adjacent panels in different installation positions, FIGS. 2 and 3 each a cross section through the joining region of two adjacent panels in two further installation positions and FIG. 4 each a cross section through the joining region of two adjacent panels in a further installation position

DETAILED DESCRIPTION OF PREFERRED EMBODIMENTS

Figure 1A:
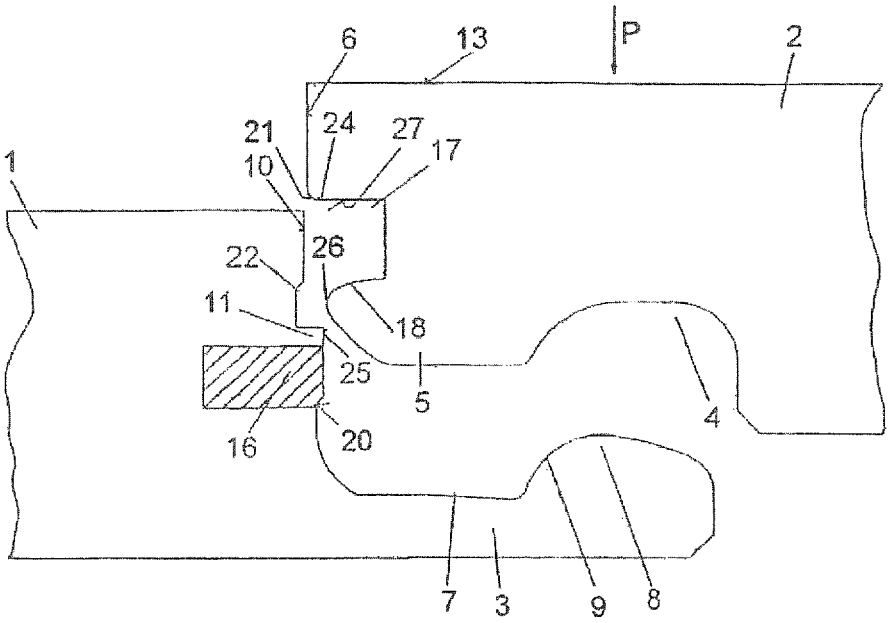
Figure 1B:
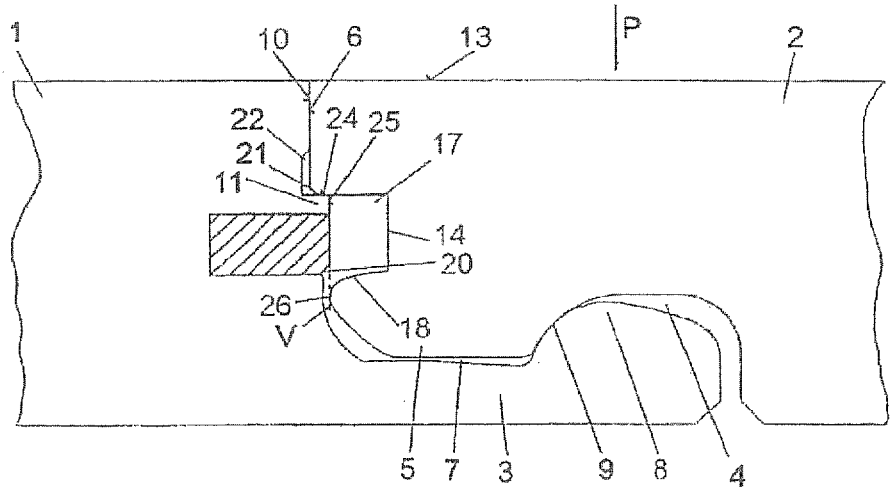

FIG. 1*a* shows a cross section through two panels 1, 2. This can be a longitudinal or head side cross section of the panels 1, 2. The panels 1, 2 are configured identical, such that the panels 1, 2 can be assembled into a floor covering. FIG. 1*a* shows two adjacent panels 1, 2 before the engagement. The illustration shows on the left a first panel 1 and on the right a second panel 2, for joining with the first panel 1. The first panel 1 has a locking rail 3 and panel 2 has a coupling channel 4 which is open to the bottom and, adjoining the coupling channel 4, an end side coupling bulge 5 which is oriented downwards. The locking rail 3 of the first panel 1 protrudes over a head side which in the embodiment is referred to only as side 6. Panel 2 is arranged relative to panel 1 such that when lowered in the direction of the arrow P coupling bulge 5 of the second panel 2 engages with the coupling channel 7 of the locking rail 3 and the coupling channel 4 of the second panel 2 with the coupling bulge 8 of the locking rail 3. During this, a tip 26 of the coupling bulge 5 of the second panel slides along a front edge of the support rail which protrudes from the side 10 of the first panel 1, until an upper groove flank 27 of the groove 17 of the second panel 2 rests on a top side 24 of the support rail 11 of the first panel 1, and the side 6 of the second panel 2 rests against the side 10 of the panel 1. In this position, a region of contact 9 forms between the coupling channel 4 of the second panel 2 and the coupling bulge 8 of the locking rail 3 of the first panel 1. During this, the second panel 2 comes into engagement with the first panel 1 in such a way that the second panel 2 is pre-tensioned and is pushed with its side 6 against the side 10 via the region of contact 9 (FIG. 1*b*) between the coupling channel 4 and the coupling bulge 8. In this position the tongue 16 is still arranged in the groove 17. In the third step (FIG. 1*c*) this tongue moves out of groove 12 into the groove 17 and locks the panels 1, 2 to one another.

Through the indentation of the coupling bulges 5, 8, the two panels 1, 2 are secured against displacement in the plane of installation which means in horizontal direction of the installed floor covering. Because the coupling bulges 5, 8 abut each other in their region of contact 9 at an angle of about 55° to 60° relative to the plane of installation, the second panel 2 is pulled towards the already installed first panel 1, with its side 10 which is complementary to the side 6 of the first panel 1, when pivoting the second panel 2 downwards, such that the sides 6, 10 of the panels 1, 2 abut each other.

In addition to the contact between the coupling bulges 5, 8 the second panel 2 rests on a support rail 11 above a groove 12. The support rail 11 is thus located at a shorter distance to the top side 13 of the right panel 2 than the locking rail 3, on which the panel 2 is normally supported in also in a vertical direction. Because of the shorter distance of the support rail 11 to the top side tighter tolerances can be maintained, such that with this solution a possible height offset between panel 1, 2 can be minimized. The support rail 11 borders directly on the groove 12, such that its bottom edge 14 is a part of an upper groove flank 15 of the groove 12. The support rail 11 thus co extends with the tongue 16, which is already displaced from the first panel 1 into the second panel 2, into the corresponding groove 17 in the right panel 2. The groove width 17 is correspondingly greater than the thickness of the tongue 16 measured in vertical direction.

As can be seen from the Figures, the groove 17 not only has a greater groove width in the right panel 2 but also a groove flank 18 which, in contrast to the lower groove flank 23 of the left groove 12, is convexly arched, such that the groove 17 is widened at the mouth side. The arching of the groove flank 18 is elliptical, such that the tongue 16 runs onto the groove flank 18 when being displaced in the direction of the arrow P1, and hereby becomes slightly canted relative to the groove 12 and the groove 17. The top side 19 of the tongue 16 is pushed against the upper groove flank 15 from below in the region of the support rail 11, such that the tongue 16, via the region of contact K with the lower groove flank 18, pulls the right panel 2 further downward into the coupling channel 7 of the first panel 1 or pushes the right panel 2 downwards against the top side 24 of the support rail 11 of the first panel 1, respectively. Because of this downward oriented force and the angled position of the coupling bulges 5, 8, a horizontally as well as vertically acting force is applied in the region of contact 9 between the coupling bulges 5, 8, wherein the horizontal force component causes the sides 6, 10 of the panels 1, 2 to be pushed tighter against each other.

In this embodiment a convex beveled surface of the coupling bulge 8 is formed by two convex sections with different radii R1, R2, which merge into one another. In the region of contact, in the installation position shown here, the angle formed between the beveled surface and the horizontal is about 60°. The angle of the beveled surface can facilitate a later releasing of the connection, which means a lifting of the panel.

For the tongue 16 to run onto the groove flank 18 of the groove 17 more easily, a front lower edge of the tongue is provided with a chamfer 20. A chamfer 21 can also be seen in the region of the upper groove flank of the groove 17 which in the image plane is on the right. This chamfer 21 and an indentation 22 in the opposing side 6 of the first panel 1 allow that possible contaminations do not lead to a height offset between the panels 1, 2 and to be displaced into the indentation 22.

The panels 1, 2 contact each other only at certain support and holding points. The locking rail 3 and the coupling bulge 5 contact each other in this embodiment only in the previously described region of contact 9. However, the remaining spaces between the locking rail 3 and the coupling bulge 5 are gaps which are so small that in the case of an extreme vertical load a contact cannot be excluded, which is due to the elasticity of the used materials. The spaces further allow compensating manufacturing tolerances.

It can further be seen in the illustration that a vertical plane V, drawn as a dotted line, extends in the plane of a front edge 25 of the support rail 11. It can further be seen that an outermost tip 26 of the coupling bulge or of the lower groove flank 18, respectively, does not extend over this vertical plane V in the direction towards the adjacent panel 1. Preferably, the tip 26 is positioned in the image plane more to the right than to the left of the vertical plane V, such that when pivoting the panel 2, which is on the right in the image plane, down onto the left panel 1, the coupling bulge 5 or the tip 26 of the coupling bulge 5, respectively, can be guided past the front edge 25 of the support rail 11. Theoretically, it is also possible that in the locking position, the tip 26 of the coupling bulge 5 is positioned slightly to the left of the vertical plane V, which can be achieved in that the "upper" panel 2 slides off in the region of contact 9 of the locking rail 3 and by that is displaced towards the left in the image plane. This however always requires the face sides 6, 10) of the panels to be arranged at a distance to each other which then decreases upon locking. However, because of the occurring friction forces, the required force for lowering the panel 2 is slightly greater than in the case where the tip 26 can be guided frictionless past the front edge 25 of the support rail 11.

Figure 2:
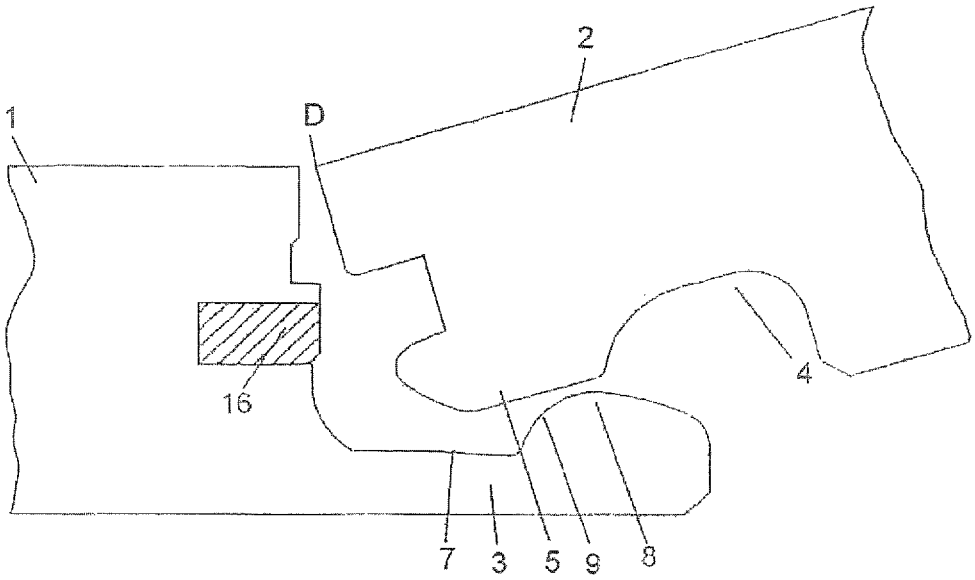
Figure 3:
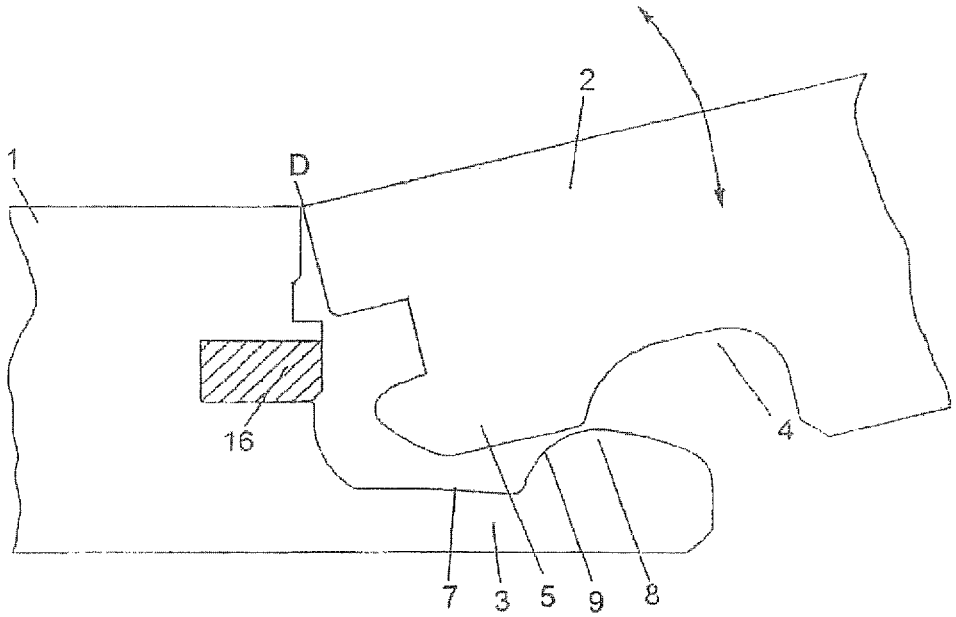

The illustrations of FIGS. 2 and 3 show a further possible way in which the panels 1, 2 can be brought into engagement with each other. The left panel 1 is already installed. The right panel 2 is approached at an angle relative to the plane of installation i.e. at an angle to the installed panel 1 until the panels contact each other at their edges in the region of their top sides. This point of contact or this line of contact, respectively, defines the pivot point D, or the pivot axis, respectively, which coincides with the decor edge. In the second step, the right panel 2 is pivoted downward about the pivot point D (FIG. 3), wherein the coupling bulge 5 of the right panel 2 is guided past the coupling bulge 8 into the coupling channel 7 of the locking rail 3. At the same time the coupling bulge 8 of the locking rail 3 slides into the coupling channel 4 of the other panel 2 until the panels 1, 2 are supported in the region of contact.

Figure 1C:
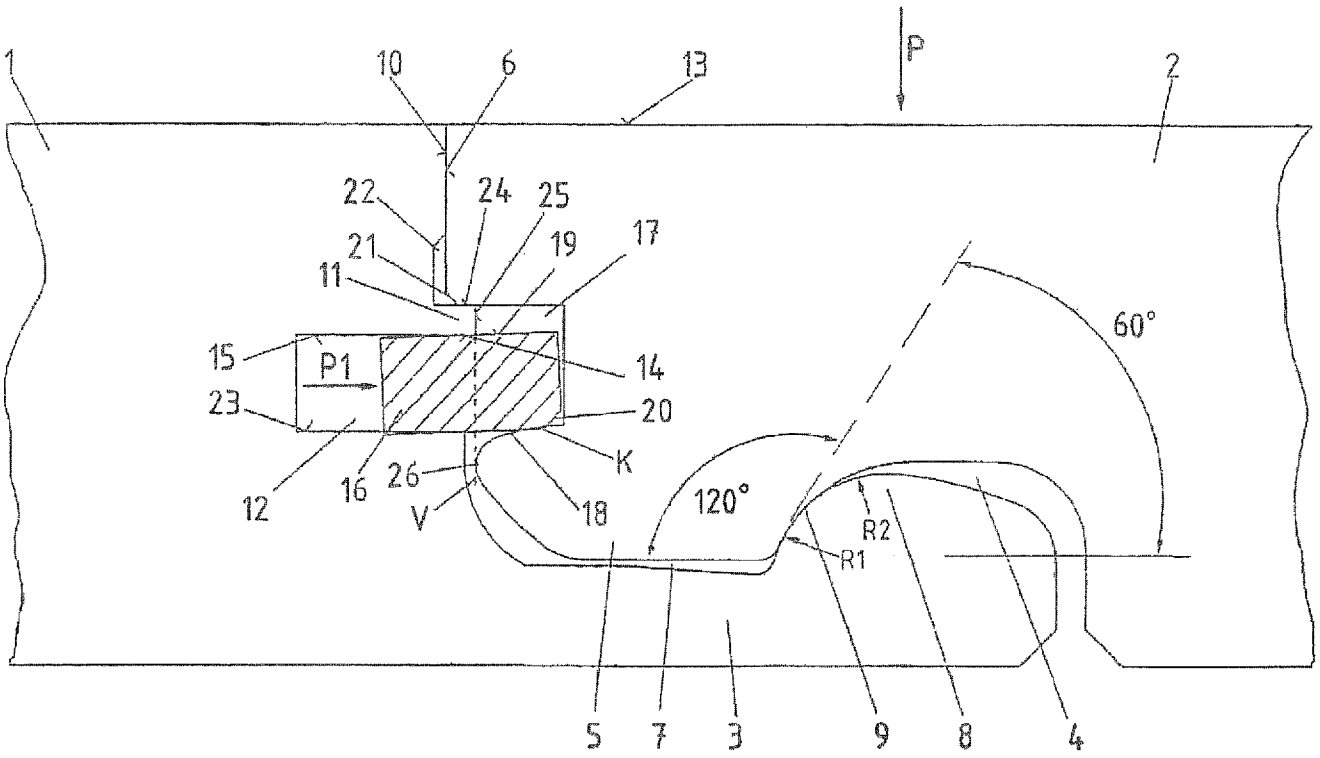

The double arrow in FIG. 3 illustrates that in this way, the right panel 2 can not only be installed but also lifted again, which is even possible when the tongue 16 as shown in FIG. 1*c*, is extended.

Figure 4:
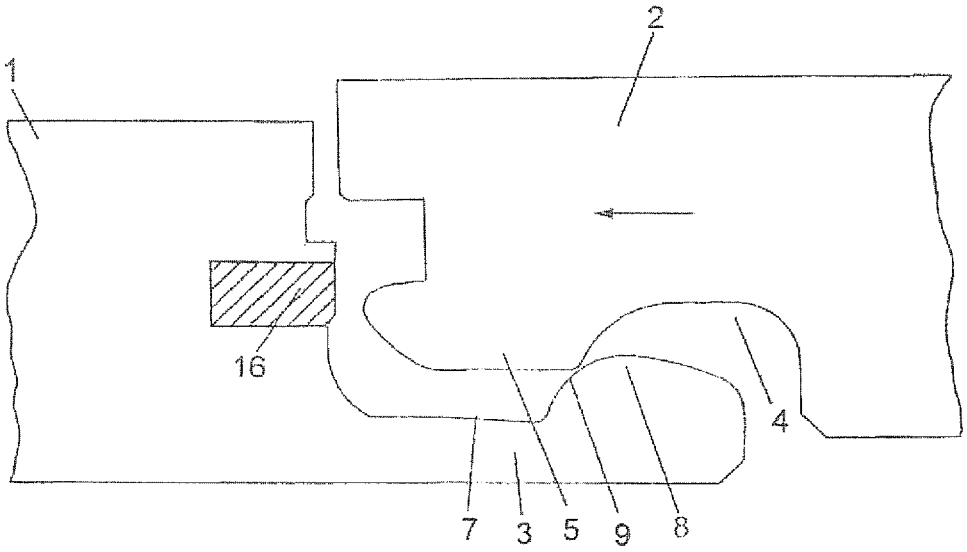

The variant according to FIG. 4 shows the horizontal insertion of the right panel 2 into the left, already installed panel 1. The panels 1, 2 remain essentially parallel to each other. The coupling bulge 5 of the right panel 2 is slightly lifted and guided past the coupling bulge 8 of the locking rail into the coupling channel 7 of the locking rail 3. The coupling bulge 8 of the locking rail 3 slides into the coupling channel 4 of the other panel 2 until the panels 1, 2 are supported in the region of contact 9. The tongue 16 is then displaced. The tongue 16 therefore does not interfere with the horizontal insertion.

What is claimed is:

1. A covering, comprising:

first and second panels disposed adjacent to one another and having confronting sides which complement each other, each said side having a groove; and a tongue movably received in one of the grooves of one of the first and second panels for engagement in the groove of the other one of the first and second panels when the first and second panels are connected, wherein the one of the first and second panels has a support rail and a locking rail, said locking rail engaging underneath the other one of the first and second panels for protecting the first and second panels against a tensile force in a plane of installation, and wherein the other one of the first and second panels is supported on the locking rail in a direction perpendicular to the plane of installation and is supported on the support rail only in a direction different from the direction perpendicular to the plane of installation, said support rail being disposed at a greater distance to the locking rail than the one of the grooves of the first and second panels and engaging in the groove of the other one of the first and second panels.

2. The covering of claim 1, wherein the tongue in a locking position is at least partially bent and maintained under tension at a transition from the groove of the first panel to the groove of the second panel.

3. The covering of claim 1, wherein the support rail has a top side which is arranged at a distance to a top side of the one of the first and second panels, said distance being 10% to 35% of a total thickness of the one of the first and second panels.

4. The covering of claim 1, wherein the one of the first and second panels has an indentation which adjoins a top side of the support rail.

5. The covering of claim 1, wherein the other one of the grooves of the first and second panels has a width which at a narrowest point thereof is sized greater than 1.1 times a width of the tongue.

6. The covering of claim 1, wherein the groove of the other one of the first and second panels has a lower groove flank with a front tip which extends in a same vertical plane as a front edge of the support rail.

7. The covering of claim 1, wherein the support rail is arranged adjacent to the one of the grooves of the first and second panels.

8. The covering of claim 7, wherein the support rail has a bottom edge which forms part of an upper groove flank of the one of the grooves of the first and second panels.

9. The covering of claim 8, wherein the one of the grooves of the first and second panels has a lower groove flank which is shorter than an upper groove flank of the one of the grooves of the first and second panels.

10. The covering of claim 1, wherein the other one of the first and second panels has a lower groove flank which widens towards a mouth of the groove of said panel.

11. The covering of claim 10, wherein the lower groove flank is rounded.

12. The covering of claim 11, wherein the lower groove flank is elliptically curved.

13. The covering of claim 1, wherein the first and second panels contact one another in a region of contact of the locking rail, said region being formed as beveled surface and arranged at an angle of less than 90° relative to the plane of installation.

14. The covering of claim 13, wherein the angle is less than 60°.

15. The covering of claim 13, wherein the beveled surface is convex.

16. The covering of claim 15, wherein the convex beveled surface is formed by at least two sections which merge into one another, said sections having different radii.

17. A method for installing the covering of claim 1, comprising:

coupling a plurality of the first and second panels of claim 1 via the locking rails to thereby engage the panels with one another; and locking the adjacent panels via the tongue, wherein the confronting sides of adjacent panels are interconnectable in one of three ways, a first way in which the further one of the panels is connected with the one of the first and second panels through horizontal shift in a plane of installation so that the further one of the panels slidingly engages via the locking rail into the locking position, a second way in which an upper edge of the further one of the panels is placed in abutting relationship to the one of the first and second panels and the further one of the panels is pivoted about the edge and shifted into the locking position, a third way in which the further one of the panels is placed from atop upon the locking rail of the one of the first and second panels, with the groove of the one of the first and second panels and the groove of the other one of the first and second panels being oriented parallel to one another, or positioned at an angle to one another when beginning to pivot the further one of the panels upon the locking rail of the one of the first and second panels about a pivot axis, with the angle decreasing during placement and with the pivot axis lying in the plane of installation and extending perpendicular to the grooves.

18. A method for disassembling the covering installed according to the method of claim 17, said method comprising: pivoting the one of the first and second panels, which is engaged underneath by the locking rail, about an upper edge which borders the other one of the first and second panels having the locking rail.

* * * * *